US007431620B1

(12) United States Patent
Harley

(10) Patent No.: US 7,431,620 B1
(45) Date of Patent: Oct. 7, 2008

(54) ARTICULATING SURFACE DRIVE

(76) Inventor: Howard D. Harley, 300 S. First Ave., Bartow, FL (US) 33830

( * ) Notice: Subject to any disclaimer, the term of this patent is extended or adjusted under 35 U.S.C. 154(b) by 0 days.

(21) Appl. No.: 11/753,308

(22) Filed: May 24, 2007

Related U.S. Application Data

(60) Provisional application No. 60/803,039, filed on May 24, 2006.

(51) Int. Cl.
*B63H 5/20* (2006.01)

(52) U.S. Cl. ..... 440/53

(58) Field of Classification Search ..... 440/53, 440/83
See application file for complete search history.

(56) References Cited

U.S. PATENT DOCUMENTS

| | | | | |
|---|---|---|---|---|
| 931,159 | A | 8/1909 | Stribling | |
| 2,076,603 | A | 4/1937 | Svendsen | |
| 2,242,642 | A | 5/1941 | Bogert | |
| 2,370,212 | A | 2/1945 | Van Gorden | |
| 2,415,183 | A | 2/1947 | Law | |
| 2,856,883 | A | 10/1958 | Baker | |
| 3,057,320 | A | 10/1962 | Daniels | |
| 3,469,558 | A | 9/1969 | Puretic | |
| 3,752,111 | A | 8/1973 | Meynier, Jr. | |
| 3,933,116 | A | 1/1976 | Adams et al. | |
| 3,976,027 | A | 8/1976 | Jones, Sr. | |
| 4,304,191 | A | 12/1981 | Algard | |
| 4,726,796 | A | 2/1988 | Rivette, Jr. et al. | |
| 4,747,796 | A * | 5/1988 | Iwai et al. | 440/83 |
| 4,775,342 | A | 10/1988 | Connor et al. | |
| 4,976,638 | A | 12/1990 | Grinde | |
| 5,037,337 | A | 8/1991 | Richter | |
| 5,290,182 | A | 3/1994 | Mondelop | |
| 5,326,294 | A | 7/1994 | Schoell | |
| 5,439,403 | A | 8/1995 | Rolla | |
| 5,667,415 | A * | 9/1997 | Arneson | 440/66 |
| 5,931,710 | A | 8/1999 | Johnson, Sr. | |
| 6,234,854 | B1 | 5/2001 | Rydzewski | |
| 6,431,927 | B1 | 8/2002 | Sage | |
| 6,458,003 | B1 | 10/2002 | Krueger | |
| 6,468,119 | B1 | 10/2002 | Hasl et al. | |
| 6,478,646 | B1 | 11/2002 | Fukuoka et al. | |
| 6,540,572 | B2 | 4/2003 | Buzzi | |
| 2002/0127928 | A1 | 9/2002 | Buzzi | |
| 2004/0198107 | A1 * | 10/2004 | Wilson | 440/49 |

FOREIGN PATENT DOCUMENTS

| | | | |
|---|---|---|---|
| EP | 000090497 | A2 | 10/1983 |

* cited by examiner

*Primary Examiner*—Stephen Avila
(74) *Attorney, Agent, or Firm*—Ronald E. Smith; Smith & Hopen., P.A.

(57) ABSTRACT

A watercraft having an inboard motor and a transom aft of the motor includes an elongate propeller shaft. A propeller is mounted to a distal end of the propeller shaft and a universal joint is disposed in engaging relation to a proximal end of the propeller shaft. The universal joint includes a frame adapted to pivot about a horizontal axis and a vertical plate adapted to pivot about a vertical axis. A central aperture formed in the vertical plate receives the proximal end of the propeller shaft. Hydraulic cylinders control the respective instantaneous positions of the frame and the vertical plate. The universal joint and the hydraulic cylinders are disposed fore of the transom.

26 Claims, 10 Drawing Sheets

ARTICULATING SURFACE DRIVE

CROSS-REFERENCE TO RELATED DISCLOSURES

This disclosure is a continuation of U.S. provisional patent application No. 60/803,039, entitled "Articulating Surface Drive," filed May 24, 2006 by the same inventor, which application is hereby incorporated by reference into this disclosure.

BACKGROUND OF THE INVENTION

1. Field of the Invention

This invention relates, generally, to marine surface piercing drives. More particularly, it relates to a surface drive where the entire articulating mechanism, including the point of articulation, as well as the parts that mount the drive, and control and articulate the trim and steering of the surface drive, are mounted internally, i.e., forwardly of the transom.

2. Description of the Prior Art

Marine surface drives are typically mounted aft of the transom. They enable a propeller to be operated at least partially out of the water if desired. Some also improve the ability to steer a watercraft by providing a universal mount for the propeller shaft that enables simultaneously raising and lowering the propeller while pivoting the shaft to the left and right.

The marine surface drives heretofore known are heavy, complex, large, and often high maintenance units. Their weight and high cost reduces their performance characteristics and limits their applications. They are mounted aft of the transom and the parts thereof are exposed to the deleterious effects of water.

There is a need for a lighter in weight, less complex, and less expensive structure that is also protected from the water that supports the watercraft. The needed apparatus should be easy to manufacture and install and should exhibit enhanced performance characteristics.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for a means for an improved marine surface piercing outdrive is now met by a new, useful, and non-obvious invention.

Internal, i.e., forward of the transom mounting of the novel apparatus facilitates its installation. Protecting the apparatus from exposure to water increases the reliability of the apparatus and reduces the amount of maintenance required. The small, light-in-weight parts are of modular construction, thereby further facilitating assembly and obviating any need for machinery to lift heavy parts. The apparatus is less complex, lighter in weight, and more compact in size than the surface drives heretofore known. It is far less complex, and lighter in weight, and more compact than any other fully articulating surface drive. It provides increased performance and better fuel efficiency yet is less expensive to manufacture, more affordable, and more practical for mass produced boats than the surface drives heretofore known.

More particularly, the novel apparatus provides up to thirty per cent (30%) better performance and economies relative to standard shaft angle inboard, up to fifteen per cent (15%) gain in speed and efficiency relative to conventional stern drives, and up to forty per cent (40%) gain in mid-range cruise speeds and economies compared to jet drives.

The trimable drive enables shallow draft running capabilities. Increased speed and efficiency result from the ability to raise the drive, optimize the trim angle, elevate the propeller, and reduce underwater appendage drag.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1A:
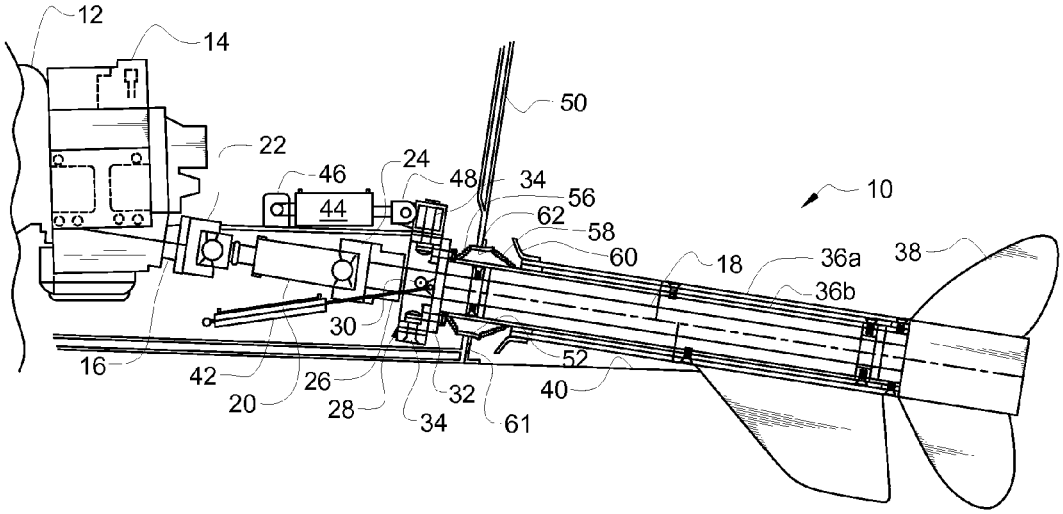
FIG. 1A is a side elevation view of a first embodiment of the novel marine outdrive.
Figure 2:
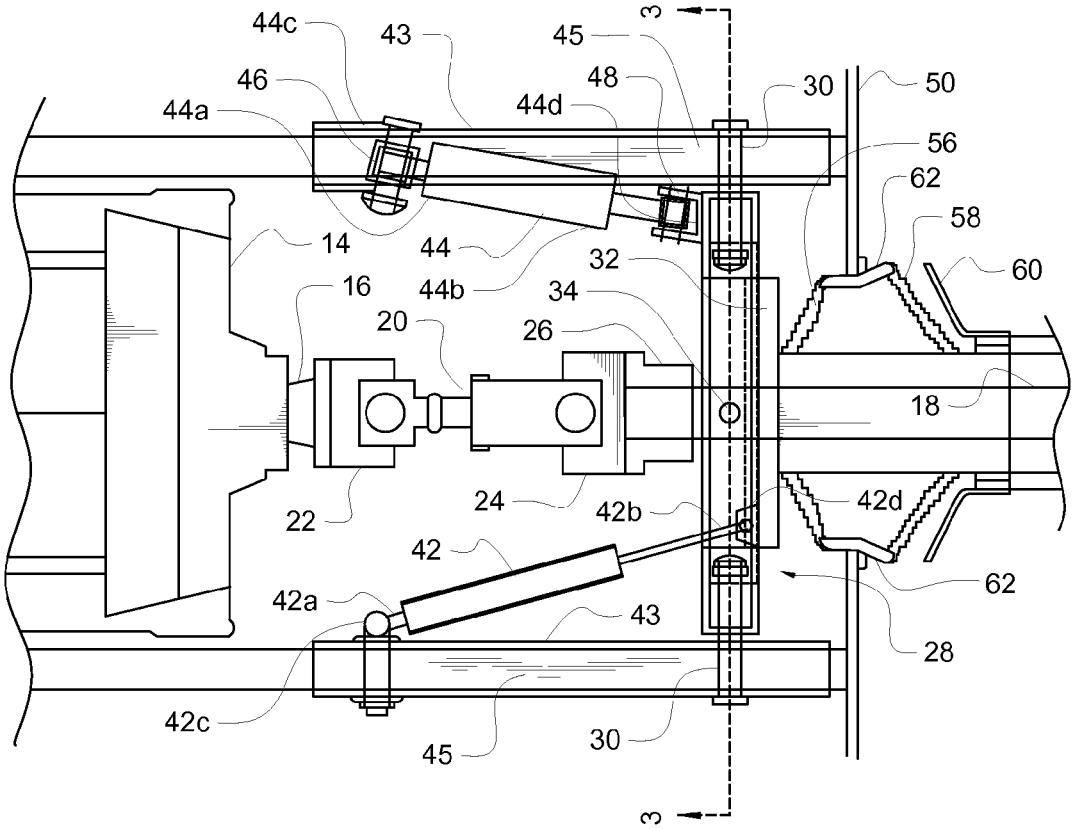
FIG. 2 is a partial top plan view of the first embodiment.

Referring now to FIGS. 1A and 2, it will there be seen that an illustrative embodiment of the invention is denoted as a whole by the reference numeral 10.

Outdrive assembly 10 is formed collectively by inboard motor 12 having transmission 14 connected thereto in a well-known way. The axis of rotation of transmission output shaft 16 is mounted typically fixed at an angle of about three to eight degrees (3-8°) downwardly relative to a horizontal plane.

The power provided by output shaft 16 is transmitted to propeller shaft 18 by jackshaft 20. This solid, short round-in-transverse section shaft is also known as a countershaft. The leading end of jackshaft or countershaft 20 is rotatably mounted in leading constant velocity joint or universal joint 22 and the trailing end of jackshaft or countershaft 20 is rotatably mounted in trailing constant velocity or universal joint 24.

The leading end of propeller shaft 18 is secured to companion flange 26 that receives the leading end of propeller shaft 18 and which rotates conjointly therewith. Companion flange 26 is secured to universal or constant velocity joint 24.

The axis of rotation of output shaft 16 of transmission 14 and the axis of rotation of propeller shaft 18 are not necessarily in alignment with one another. The function of jackshaft 20 and constant velocity or universal joints 22, 24 is to enable power transmission in the form of rotary motion from output shaft 16 to propeller shaft 18 with minimal friction and limited freedom of movement in any direction. This provides both trim and steering of the drive.

Figure 1B:
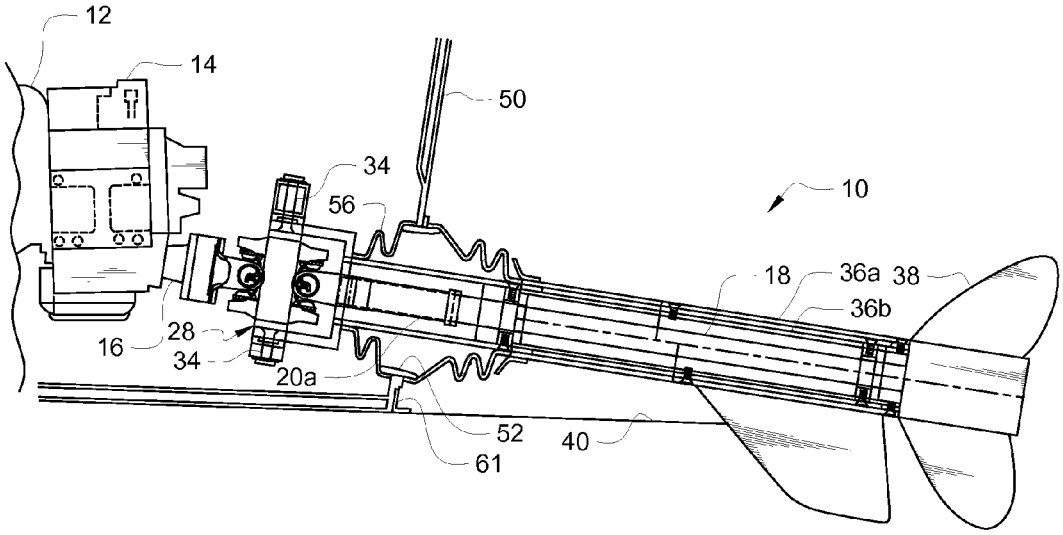
FIG. 1B is a side elevational view of a second embodiment.

In a second embodiment, depicted in FIG. 1B, jackshaft 20*a*, also known as a slider shaft, extends through opening 52 formed in transom 50 and said jackshaft 20*a* slideably receives the leading end of propeller shaft 18. The interior diameter of jackshaft 20*a* is therefore slightly greater than the exterior diameter of propeller shaft 18. A plurality of longitudinally-extending, circumferentially spaced male splines are formed in the leading end of propeller shaft 18 and extend radially outwardly therefrom. Such splines are slideably received within female receiver splines formed in the lumen of jackshaft 20*a* so that said propeller shaft is free to slide longitudinally in the fore and aft directions. Jackshaft 20*a* allows necessary fore and aft movement to accommodate the small changes in length that occur on the jackshaft as the drive trims up or down and steers left or right. As suggested by a comparison of FIGS. 1A and 1B, the embodiment of FIG. 1B is shorter in length than the embodiment of FIG. 1A, thereby saving valuable space on the watercraft.

Figure 3A:
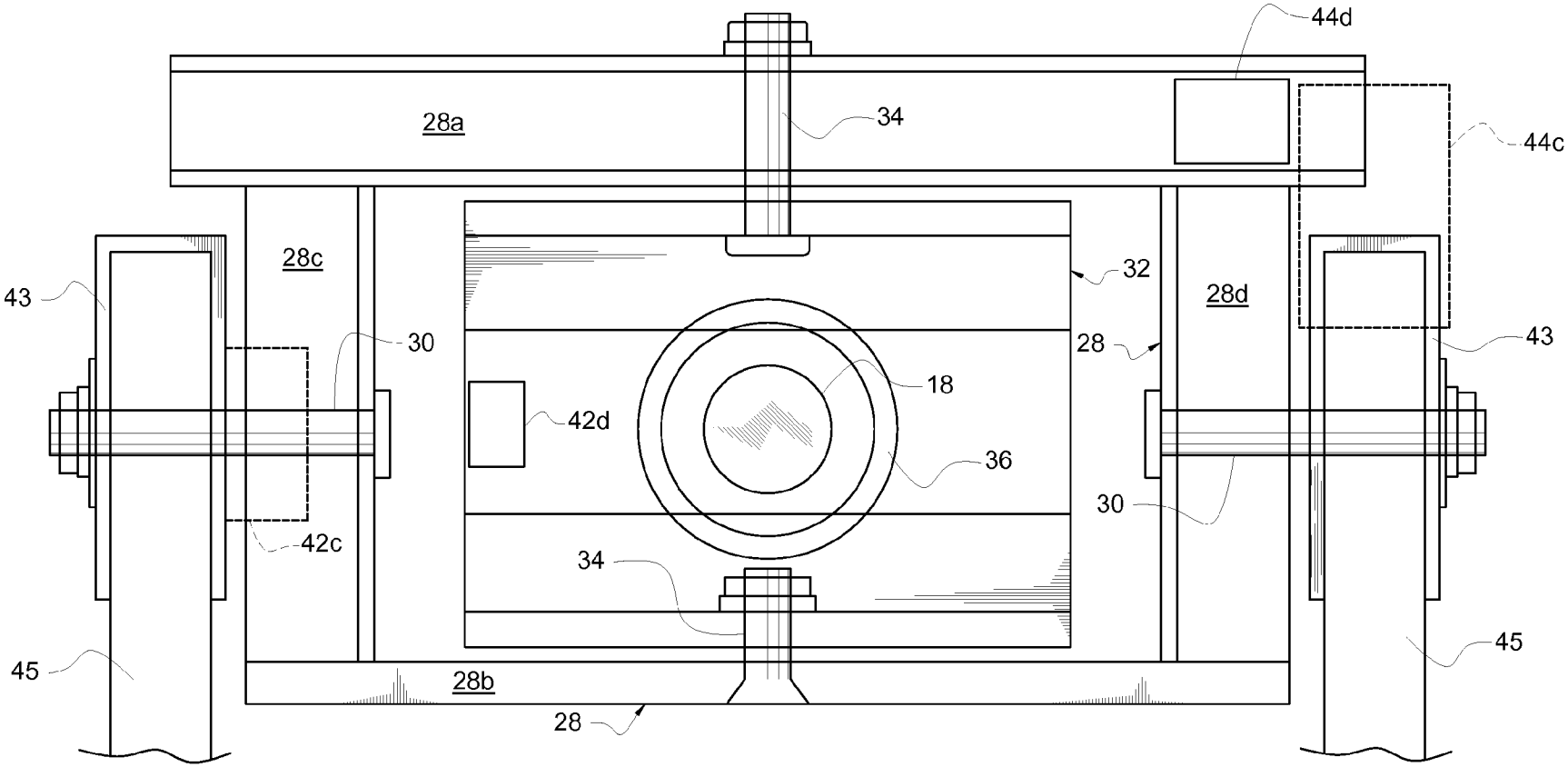
FIG. 3A is a sectional view of the novel swivel mechanism, taken along line 3A-3A in FIG. 2.

Trim frame 28 rotates about a pair of horizontally disposed pivot pins 30, one of which is depicted in FIG. 1 and both of which are depicted in FIGS. 2 and 3A. Vertical steering plate 32 (FIGS. 1, 2, 3A, and 3B) is mounted for rotation about a pair of vertically disposed pivot pins, collectively denoted 34. Vertical steering plate 32 is centrally apertured as depicted in FIG. 3A and drive housing 36 circumscribes said aperture and receives the leading end of propeller shaft 18 therethrough. Trim frame 28 and vertical steering plate 32 are mounted fore of the transom.

More particularly, trim frame 28 includes frame top piece 28*a*, frame bottom piece 28*b*, and frame side pieces 28*c*, 28*d* that interconnect opposite ends of frame top piece 28*a* to respective opposite ends of frame bottom piece 28*b*.

Rotation of trim frame 28 about a horizontal axis defined by horizontal pivot pins 30, 30 thus raises or lowers propeller 38 relative to water surface 40, depending upon the direction of rotation. As drawn in FIGS. 1A and 1B, counterclockwise rotation of trim frame 28 lifts said propeller and clockwise rotation lowers said propeller.

Rotation of vertical steering plate 32 about a vertical axis defined by vertical pivot pins 34, 34 turns the watercraft to the left or right, depending upon the direction of rotation. Pivot pins 34, 34 are mounted in said frame top and bottom pieces 28*a*, 28*b*.

Trim frame 28 and steering plate 32 and their related parts thus form a universal joint.

Figure 3B:
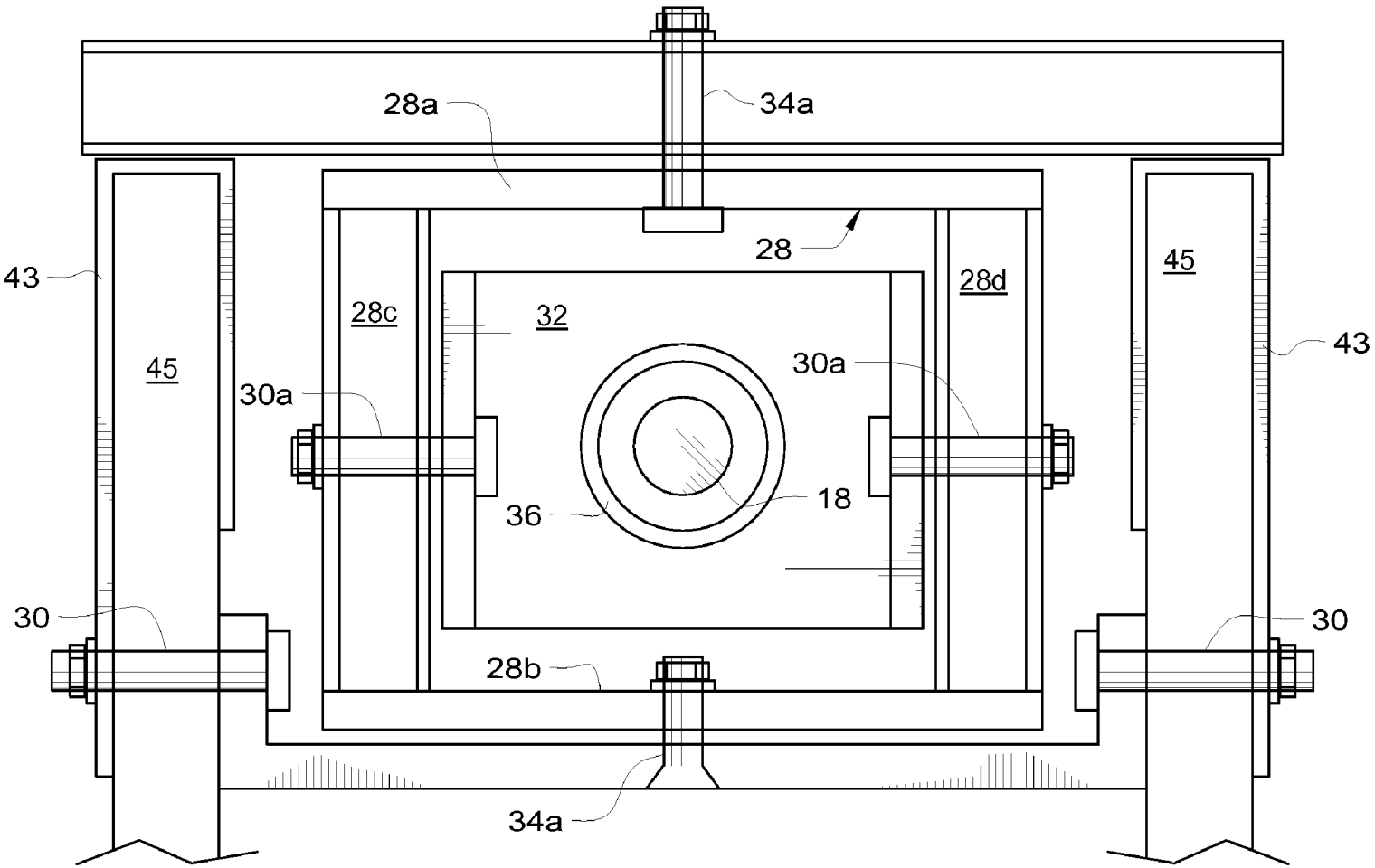
FIG. 3B depicts a second embodiment of the parts depicted in FIG. 3A.

The plane of pivoting of said trim frame and vertical steering plate is reversed in the embodiment depicted in FIG. 3B. Accordingly, trim frame 28 is mounted for rotation about a vertical axis defined by vertical pivot pins 34*a*, 34*a* and vertical steering plate 32 is mounted for rotation about a horizontal axis defined by horizontal pivot pins 30*a*, 30*a*. The parts of this FIG. 3B embodiment still cooperate with one another to form a universal joint and all of said parts are fore of the transom.

Steering cylinder 42 performs the function its name expresses. Steering cylinder 42 is pivotally mounted at its leading end to a fixed point. More particularly, as depicted in FIG. 2, leading end 42*a* is mounted to "U"-shaped channel 43 that receives stringer 45. Channel 43 is referred to in the industry as a stringer cap. Trailing end 42*b* of steering cylinder 42 is pivotally connected to steering plate 32. As best indicated in FIG. 3, the connection of leading end 42*a* to stringer cap 43 is indicated in dotted lines and is denoted 42*c*, and the connection of trailing end 42*b* to steering plate 32 is indicated in solid lines and is denoted 42*d*.

Accordingly, as best understood in connection with FIGS. 2 and 3, vertical steering plate 32 is rotated about vertical pins 34, 34 in a first direction by extension of steering cylinder 42, thereby causing the watercraft to turn in a first direction. Retraction of steering cylinder 42 rotates steering plate 32 about said vertical pins 34, 34 in a second direction opposite to said first direction, thereby causing the watercraft to turn in a second direction, opposite to said first direction.

Hydraulic trim cylinder 44 controls the instantaneous orientation of the drive through trim frame 28 and vertical steering plate 32. One or more trim cylinders may be provided, depending upon the size and weight of the watercraft. Leading end 44*a* of hydraulic trim cylinder 44 is pivotally secured to clevis 46 and said clevis 46 is mounted to "U"-shaped channel or stringer cap 43 that receives stringer 45. The trailing end of hydraulic cylinder 44 is pivotally secured to clevis 48 and said clevis 48 is fixedly secured to trim frame 28. As best indicated in FIG. 3, the connection of leading end 44*a* to stringer cap 43 is indicated in dotted lines and is denoted 44*c*, and the connection of trailing end 44*b* to trim frame 28 is indicated in solid lines and is denoted 44*d*.

Extension of trim cylinder 44 causes trim frame 28 to pivot about horizontal pivot pins 30 in a clockwise direction as drawn in FIGS. 1A and 1B, thereby driving propeller 38 deeper into water 40. Retraction of trim cylinder 44 causes trim frame 28 to pivot about pivot pins 30 in a counterclockwise direction as drawn in FIGS. 1A and 1B, thereby lifting propeller 38 away from water 40.

The assembly collectively formed by trim frame 28, vertical steering plate 32 and hydraulic cylinders 42 and 44 enables articulation of propeller shaft 18 and hence propeller 38 so that said shaft may pivot to the left and right and up and down and any combination thereof. Such universal movement has a range of up to about twenty degrees (20°) to the left and right of the longitudinal axis of the watercraft, up to about twenty-five degrees (25°) upwardly from a horizontal plane, and up to about sixteen degrees (16°) downwardly from said horizontal plane.

Significantly, jackshaft 20, steering cylinder 42, hydraulic trim cylinder 44, trim frame 28 and vertical steering plate 32 are all positioned completely fore of transom 50, i.e., complete inside the watercraft. This unique positioning of elements was unknown prior to this disclosure.

Figure 4A:
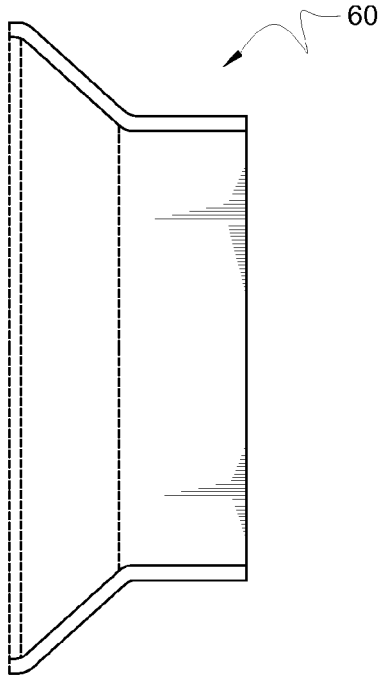
FIG. 4A is a side elevational view of the novel annular shield guard.
Figure 4B:
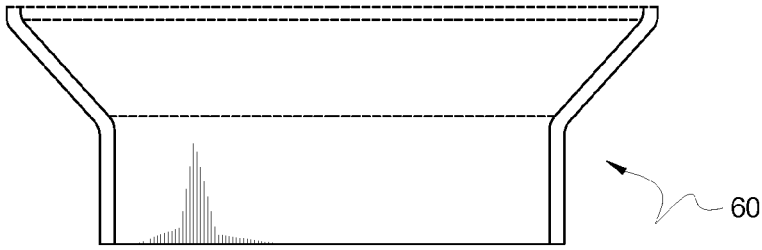
FIG. 4B is a top plan view of said shield guard.
Figure 4C:
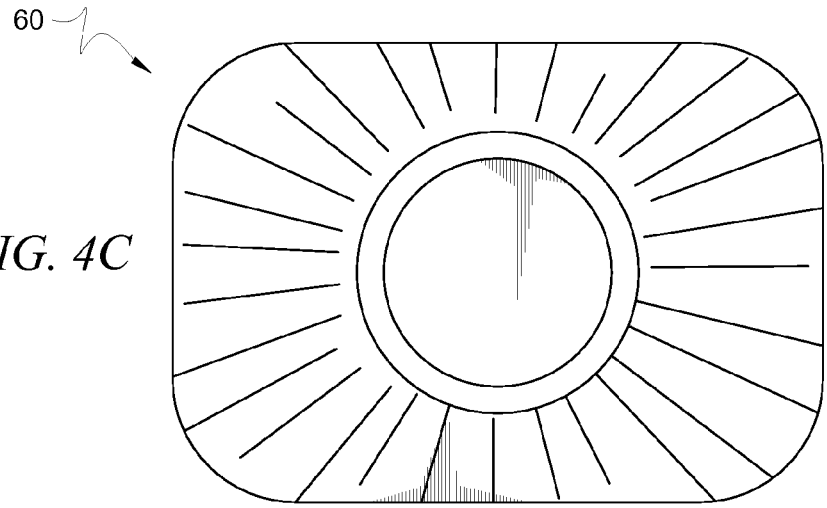
FIG. 4C is an end view of said shield guard.
Figure 5A:
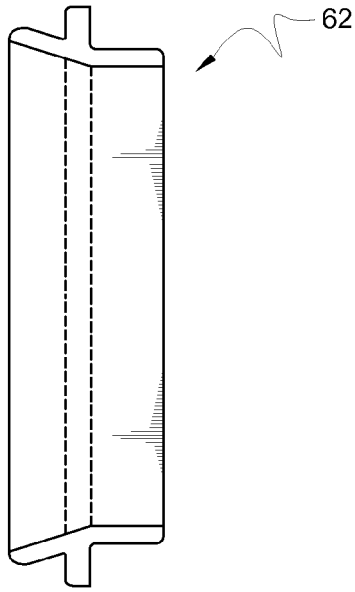
FIG. 5A is a side elevational view of the novel trim ring.
Figure 5B:
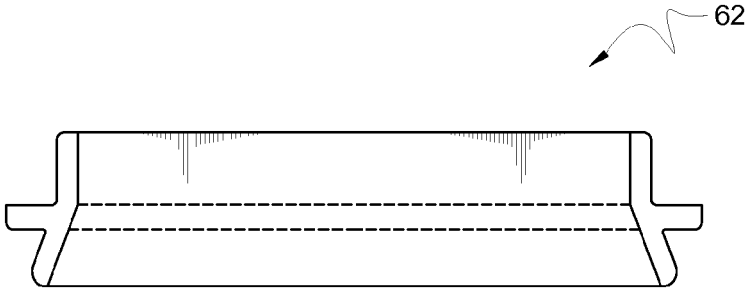
FIG. 5B is a top plan view of said trim ring.
Figure 5C:
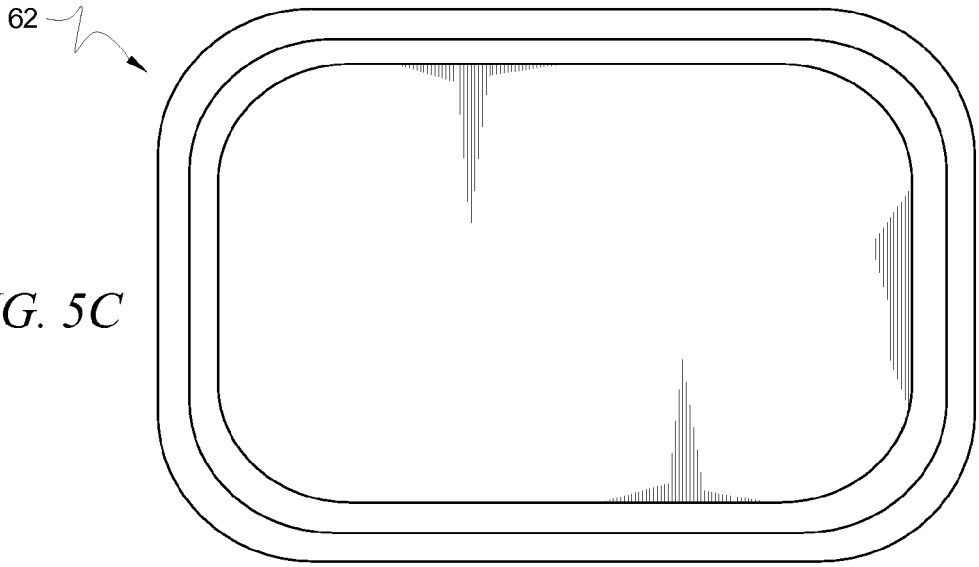
FIG. 5C is an end view of said trim ring.

Opening 52 formed in transom 50 receives drive housing or tube 36 which is preferably provided in the form of an outer drive housing 36*a* and an inner drive housing 36*b*. Annular rubber boot 56 seals inner drive housing 36*b* on the fore side of opening 52. Annular rubber boot 58 seals inner drive housing 36*b* on the aft side of said opening. Annular fiberglass shield guard 60, depicted in FIGS. 4A, 4B, and 4C, protects annular rubber boot 58, particularly when the watercraft is traveling in reverse. Spray deflector plate 61 protects the rubber boots from high speed spray when the watercraft is traveling in a forward direction. Spray deflector 61 is an L-shaped transom mounted fixed spray deflector typically molded of fiberglass composite.

Trim ring 62, which may be made of composite or metal such as stainless steel, bronze, or aluminum, is depicted in FIGS. 1A, 1B, 2, 5A, 5B, and 5C. It provides an interface and facilitates attachment between rubber boots 56, 58, and transom 50. Trim ring 62 also limits the movement of the drive so that the drive does not tear into the fiberglass transom of the boat, and also so the drive won't trim or steer past capacities that will damage the U-joint or CV joint, or exceed steering or trim positions.

Figure 6:
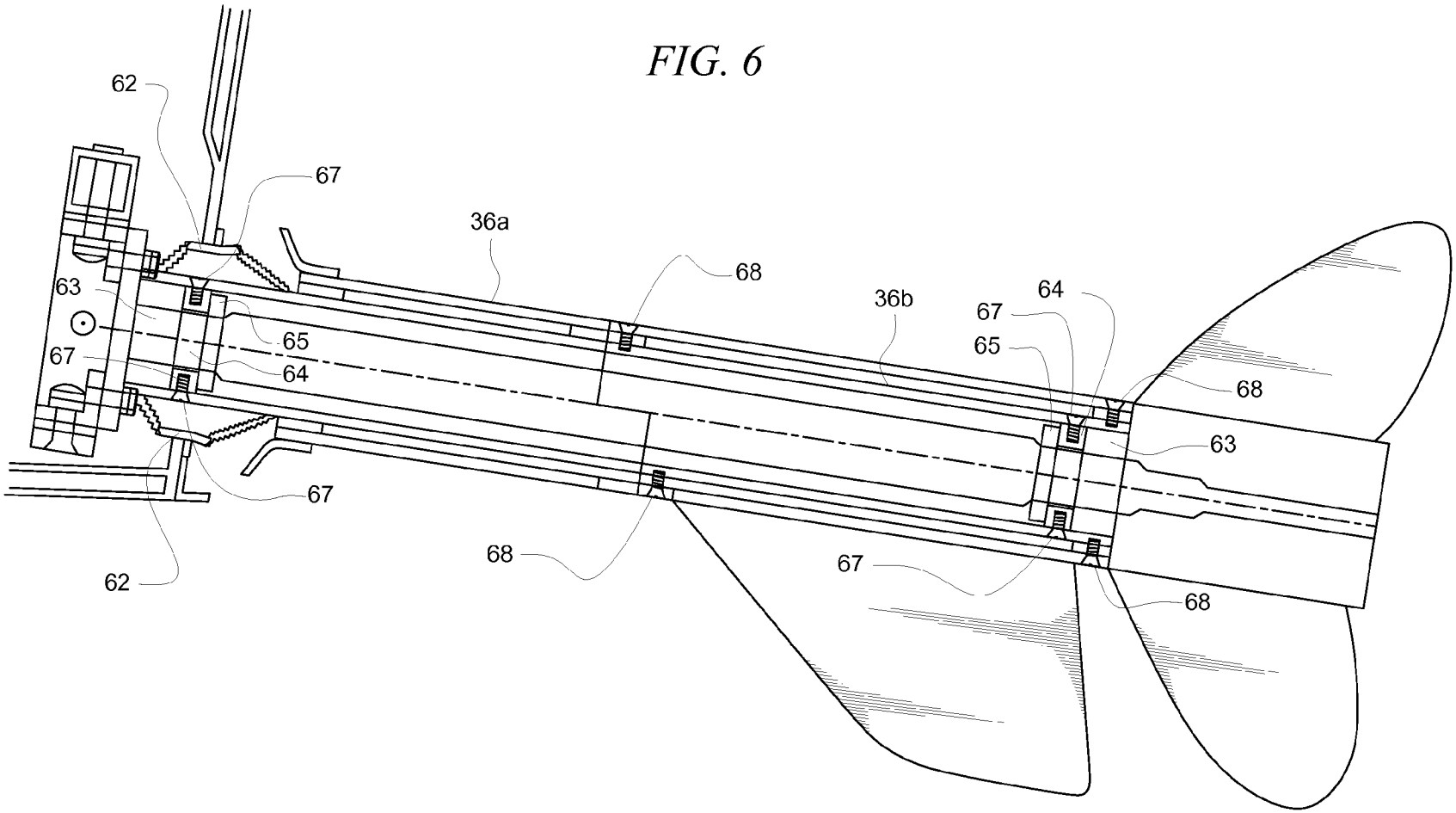
FIG. 6 is a longitudinal sectional view of the novel marine drive.

As best depicted in FIG. 6 as well as FIGS. 1A, 1B, and 3, thrust from propeller 38 is transmitted sequentially to propeller shaft 18, thrust bearing 65, thrust collar 64, thrust bolts 67, inner drive housing 36*b*, steering plate 32, vertical pins 34, trim frame 28, pivot pins 30, stringer caps 43, and to stringers 45.

Seal blocks 63, depicted in FIG. 6, are positioned on the opposing ends of the thrust bearings and thrust collars. Said seal blocks 63 contain inner O-rings and outer O-rings that seal the drive housing on each end, keeping water of the bearing area in the interior of the drive housing and keeping oil inside the drive housing to lubricate the thrust bearings.

FIG. 6 depicts removable foot 70 which when unbolted allows changing and replacing of inner rubber boots 56 and outer rubber boots 58. This unique removable section allows assembly of the drive housing through trim ring 62 and into the vessel. Foot bolts 68 secure removable foot 70 to the drive housing.

Figure 7:
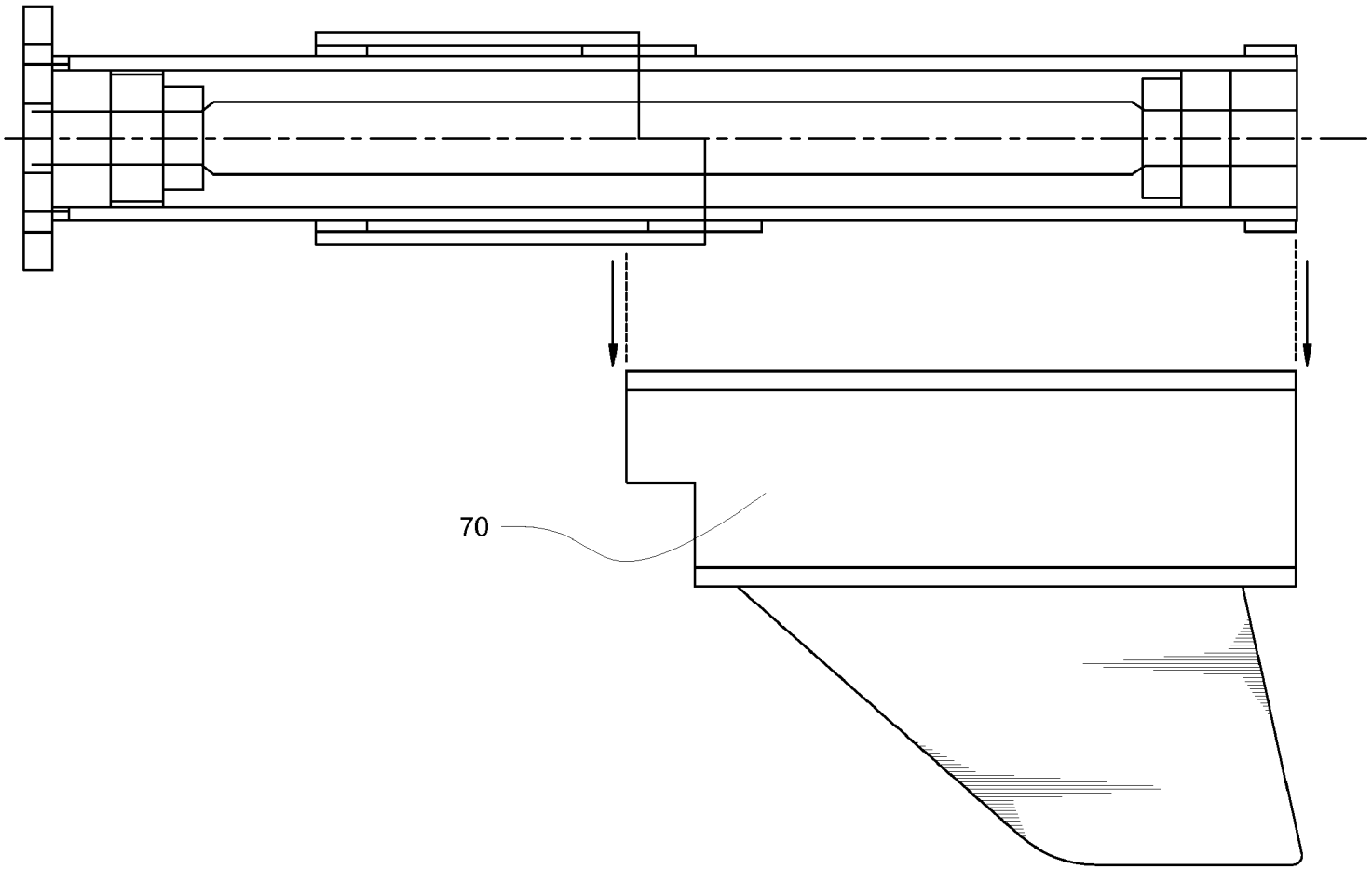
FIG. 7 is a side view depicting the removable foot on the novel marine outdrive.

Foot 70 is depicted in its removed configuration in FIG. 7.

Figure 8A:
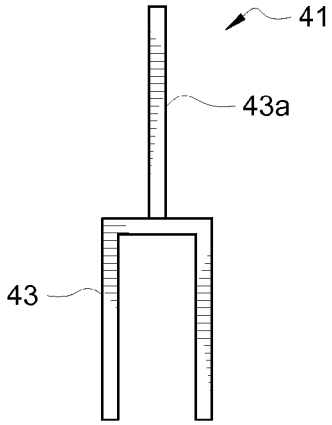
FIG. 8A is an end view of a transom gusset brace.
Figure 8B:
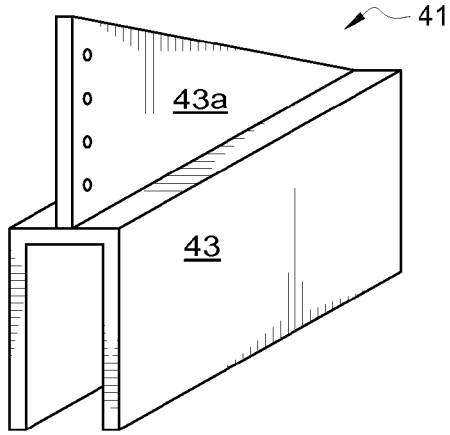
FIG. 8B is a perspective view of the transom gusset brace.

FIG. 8A is an end view and FIG. 8B is a perspective view of a transom gusset brace 41. Brace 41 is formed by a flat, triangular piece of stainless steel 43*a* that is disposed in a vertical plane and welded in surmounting and longitudinally centered relation to each stringer cap 43, there being two (2) stringer caps as indicated in FIGS. 2, 3A, and 3B. Each stringer cap 43 overlies and is bolted to a stringer 45 but the bolts are not depicted. As depicted in FIG. 8B, four (4) throughbores for receiving bolts are formed in triangular part 43*a* of brace 41. The throughbores are unnumbered to avoid cluttering the drawings and because they are easy to identify.

Figure 9A:
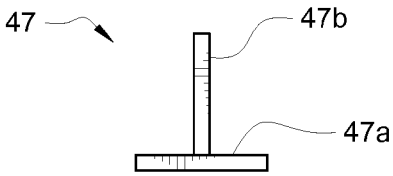
FIG. 9A is an end view of a "T"-brace.
Figure 9B:
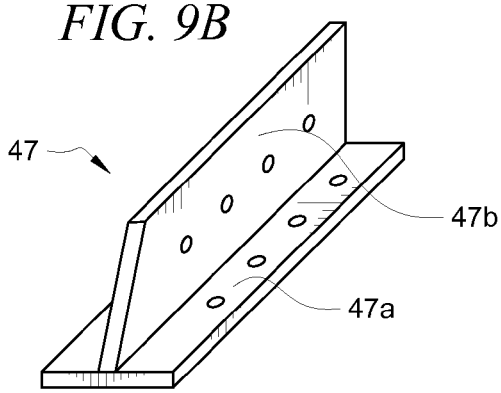
FIG. 9B is a perspective view of the "T"-brace.
Figure 9C:
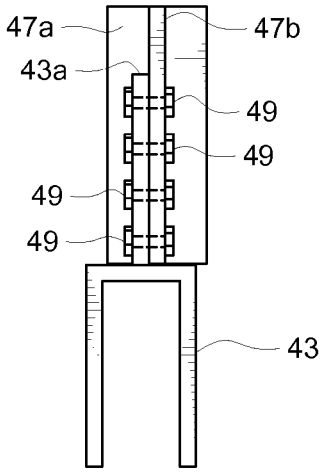
FIG. 9C is a perspective view depicting the transom brace connected to the "T"-brace.

Stringer caps 43 are perpendicular to transom 50 so the "T"-brace depicted in FIGS. 9A-C is employed to interconnect transom gusset brace 41 to said transom. FIG. 9A depicts "T"-brace 47 in end view, said "T"-brace including base 47*a* that is bolted to the transom and wall 47*b* disposed in upstanding relation to said base 47*a*. Throughbores are formed in base 47*a* and in wall 47*b* as easily understood in connection with the perspective view of FIG. 9B.

FIG. 9C depicts the interconnection of triangular-shaped part 43*a* and wall 47*b*. The unnumbered throughbores of part 43*a*, depicted in FIG. 8B, are in alignment with unnumbered throughbores formed in wall 47*b* as depicted in FIG. 9B. Bolts and nuts, collectively denoted 49 in FIG. 9C, secure wall 47*b* to triangular part 43*a* of transom gusset brace 41.

From FIG. 9C it can be understood that base 47*a* is bolted to transom 50. The throughbores formed in base 47*a* are depicted in FIG. 9B but they are not depicted in FIG. 9C to avoid cluttering said FIG. 9C.

Figure 10A:
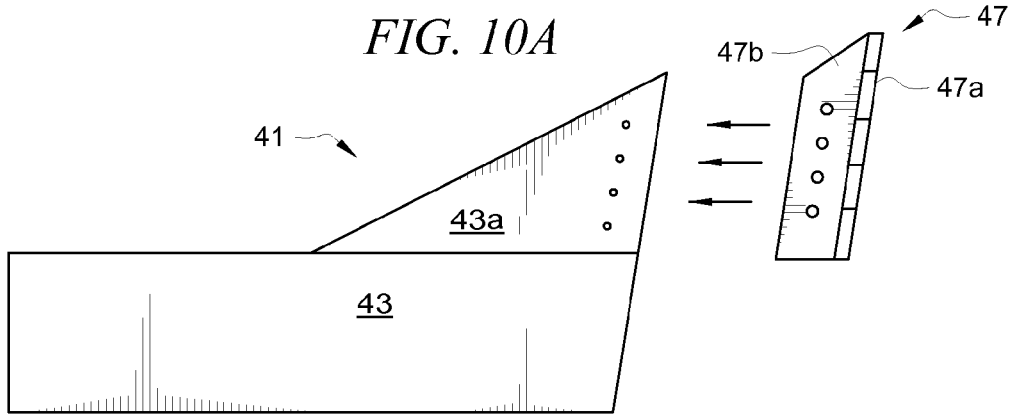
FIG. 10A is an exploded side elevational view of the transom gusset brace and a connector.

FIG. 10A depicts "T"-brace 47 in exploded relation to triangular part 43*a* of transom gusset brace 41.

Figure 10B:
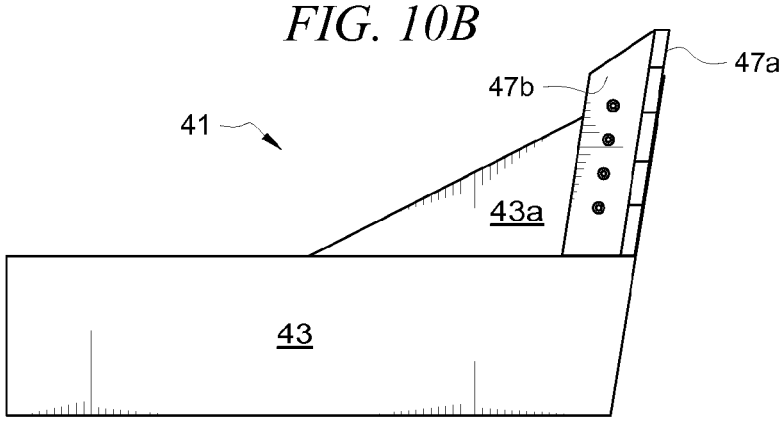
FIG. 10B is a side elevational view of the transom brace and connector disposed in secured relation to one another.

FIG. 10B depicts wall 47*b* in abutting engagement with said triangular part 43*a*. The throughbores formed in wall 47*b* are in alignment with the throughbores formed in said part 43*a*. Bolts 49 secure triangular part 43*a* to wall 47*b*.

Figure 10C:
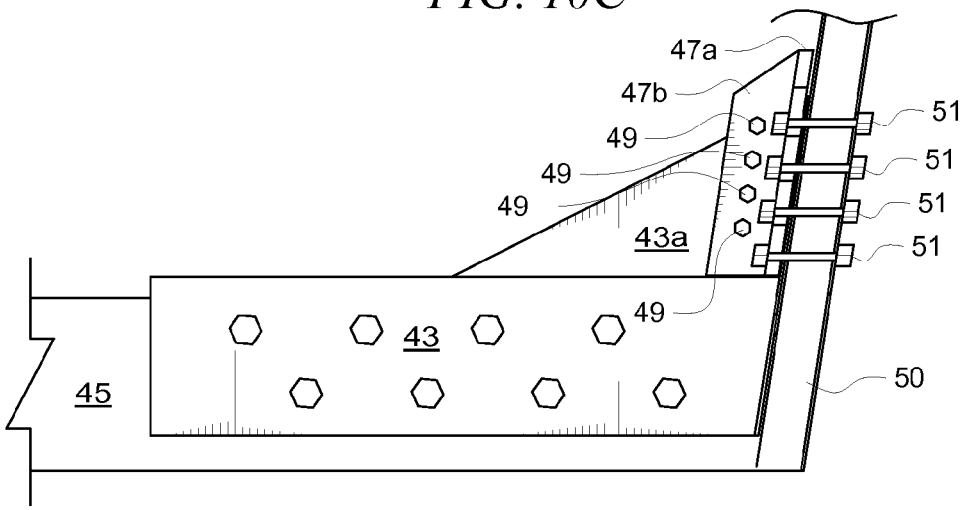
FIG. 10C is a side elevational view of the transom gusset brace and connector secured to a transom.

FIG. 10C depicts bolts 51 that secure base 47*a* to transom 50.

The purpose of transom gusset braces 41, of which there are two (port and starboard), is to further distribute thrust loads as they are applied to the transom. The braces further distribute such thrust loads to stringers 45 as well, thereby increasing the strength of the novel installation.

The novel structure has no part of the steering mechanism or controls exposed to water. All such structure is mounted fore of the transom, internally of the watercraft. This provides for an installation that is simpler and easier than installations that are aft of the transom. The installation is therefore not exposed to the deleterious effects of water and is thus far longer lasting and far more reliable than prior art installations.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A surface piercing marine drive assembly for a watercraft, comprising:

said watercraft having a transom and a propeller disposed aft of said transom;

an inboard motor disposed fore of said transom;

an articulating frame assembly disposed fore of said transom;

an output shaft connected in driven relation to said inboard motor;

a propeller shaft to which said propeller is mounted;

a countershaft for interconnecting said output shaft and said propeller shaft;

an opening formed in said transom for receiving a leading end of said propeller shaft;

said inboard motor, said output shaft, said countershaft, and said leading end of said propeller shaft being disposed fore of said transom;

said articulating frame assembly including a trim frame mounted for rotation about a horizontal axis;

said articulating frame assembly including a vertical steering plate mounted for rotation about a vertical axis;

whereby rotation of said trim frame about said horizontal axis raises or lowers said propeller relative to a water surface, depending upon the direction of rotation;

whereby rotation of said vertical steering plate about said vertical axis turns the watercraft to the left or right, depending upon the direction of rotation;

whereby the inboard motor, the articulating frame assembly, the output shaft, the countershaft, and the leading end of the propeller shaft are not exposed to the deleterious effects of water, thereby increasing the longevity and reliability of the surface piercing marine drive, and facilitating the installation of said surface piercing marine drive.

2. The surface piercing marine drive assembly of claim 1, further comprising:

said trim frame having a substantially rectangular structure including a top frame piece, a bottom frame piece, and a pair of side frame pieces interconnecting opposite ends of said top frame piece to corresponding opposite ends of said bottom frame piece.

3. The surface piercing marine drive assembly of claim 2, further comprising:

a central aperture formed in said vertical steering plate;

a propeller drive shaft being received through said central aperture;

said substantially rectangular structure of said trim frame surrounding said vertical steering plate;

whereby said trim frame and said vertical steering plate collectively form a universal joint.

4. A surface piercing marine drive assembly for a watercraft, comprising:

said watercraft having a transom and a propeller disposed aft of said transom;

an inboard motor disposed fore of said transom;

an articulating frame assembly disposed fore of said transom;

an output shaft connected in driven relation to said inboard motor;

a propeller shaft to which said propeller is mounted;

a countershaft for interconnecting said output shaft and said propeller shaft;

an opening formed in said transom for receiving said countershaft;

said inboard motor, said output shaft and said articulating frame assembly disposed fore of said transom;

said articulating frame assembly including a trim frame mounted for rotation about a vertical axis;

said trim frame being mounted fore of said transom;

said articulating frame assembly including a vertical steering plate mounted for rotation abut a vertical axis;

whereby rotation of said trim frame about said vertical axis turns the watercraft to the left or right, depending upon the direction of rotation;

whereby rotation of said vertical steering plate about said vertical axis turns the watercraft to the left or right, depending upon the direction of rotation;

whereby the inboard motor, the output shaft and the articulating frame assembly are not exposed to the deleterious effects of water, thereby increasing the longevity and reliability of the surface piercing marine drive, and facilitating the installation of the surface piercing marine drive.

5. The surface piercing marine drive assembly of claim 4, further comprising: said trim frame having a substantially rectangular structure including a top frame piece, a bottom frame piece, and a pair of side frame pieces interconnecting opposite ends of said top frame piece to corresponding opposite ends of said bottom frame piece.

6. The surface piercing marine drive assembly of claim 5, further comprising:

a central aperture formed in said vertical steering plate;

a propeller drive shaft being received through said central aperture;

said substantially rectangular structure of said trim frame surrounding said vertical steering plate;

whereby said trim frame and said vertical steering plate collectively form a universal joint.

7. A surface piercing marine drive assembly for a watercraft, comprising:

said watercraft having a transom;

said watercraft having a port stringer and a starboard stringer disposed substantially perpendicular to said transom;

an inboard motor;

said inboard motor having a transmission connected thereto;

said transmission having an output shaft, said output shaft having an axis of rotation, and said axis of rotation being normally disposed at an angle of about three to eight degrees (3-8°) downwardly relative to a horizontal plane;

a leading universal joint secured to a trailing end of said transmission output shaft;

a jackshaft having a leading end connected to said leading universal joint;

a trailing universal joint connected to a trailing end of said jackshaft;

a companion flange secured to said trailing universal joint;

a propeller shaft having a leading end connected to said companion flange for conjoint rotation therewith;

a propeller connected to a trailing end of said propeller shaft for conjoint rotation therewith;

a trim frame mounted for rotation about a horizontal axis;

a centrally apertured vertical steering plate;

said vertical steering plate mounted for rotation about a vertical axis;

a drive housing disposed in circumscribing relation to said central aperture;

said drive housing adapted to receive said leading end of said propeller shaft;

whereby rotation of said trim frame about said horizontal axis in a first direction raises said propeller relative to a water surface;

whereby rotation of said trim frame about said horizontal axis in a second direction opposite to said first direction lowers said propeller relative to said water surface;

whereby rotation of said vertical steering plate about said vertical axis in a first direction turns the watercraft to the left;

whereby rotation of said vertical steering plate about said vertical axis in a second direction opposite to said first direction turns the watercraft to the right; and whereby said trim frame and said vertical steering plate collectively form a universal joint.

8. The surface piercing marine drive assembly of claim 7, further comprising:

a steering cylinder;

a "U"-shaped stringer cap disposed in overlying relation to each of said stringers;

said steering cylinder having a leading end pivotally mounted to said "U"-shaped stringer cap;

said steering cylinder having a trailing end pivotally connected to said vertical steering plate;

whereby extension of said steering cylinder effects rotation of said vertical steering plate in a first direction and therefore turning of said watercraft in a first direction; and whereby retraction of said steering cylinder effects rotation of said vertical steering plate in a second direction opposite to said first direction and therefore turning of said watercraft in a second direction opposite to said first direction.

9. The surface piercing marine drive assembly of claim 8, further comprising:

a hydraulic trim cylinder for controlling instantaneous orientation of said outdrive by controlling said trim frame;

a hydraulic steering cylinder for controlling instantaneous orientation of said outdrive by controlling said vertical steering plate;

a first clevis mounted to said "U"-shaped stringer cap;

a leading end of said hydraulic trim cylinder being pivotally secured to said first clevis;

a second clevis secured to said trim frame;

a trailing end of said hydraulic trim cylinder being pivotally secured to said second clevis;

whereby extension of said hydraulic trim cylinder causes said trim frame to pivot about said horizontal pivot pins in a first direction, thereby driving said propeller deeper into said water;

whereby retraction of said hydraulic trim cylinder causes said trim frame to pivot about said horizontal pivot pins in a second direction opposite to said first direction, thereby lifting said propeller away from said water; and whereby said trim frame, said vertical steering plate, and said hydraulic trim cylinder enable articulation of said propeller shaft and hence said propeller so that said propeller shaft may pivot in a vertical plane to the left about twenty degrees (20°), to the right about twenty degrees (20°), and in a horizontal plane upwardly about twenty degrees (25°), downwardly to about sixteen degrees (16°), and any combination thereof.

10. The surface piercing marine drive assembly of claim 9, further comprising:

said steering cylinder, said hydraulic trim cylinder, said trim frame, and said vertical steering plate being positioned fore of said transom of said watercraft.

11. The surface piercing marine drive assembly of claim 10, further comprising:

a drive housing;

an opening formed in said transom;

said opening adapted to receive said drive housing;

a first leading rubber boot having an annular configuration adapted to seal said drive housing on a fore side of said opening; and a second trailing rubber boot having an annular configuration adapted to seal said drive housing on an aft side of said opening.

12. The surface piercing marine drive assembly of claim 11, further comprising:

an annular fiberglass shield guard for protecting said first and second rubber boots when said watercraft is traveling in a rearward direction.

13. The surface piercing marine drive assembly of claim 12, further comprising:

a spray deflector plate for protecting said first and second rubber boots from high speed spray when said watercraft is traveling in a forward direction.

14. The surface piercing marine drive assembly of claim 13, further comprising:

said spray deflector having an "L"-shape;

said spray deflector being mounted on said transom.

15. The surface piercing marine drive assembly of claim 13, further comprising:

said spray deflector being molded of fiberglass composite.

16. The surface piercing marine drive assembly of claim 13, further comprising:

said spray deflector having a metallic construction.

17. The surface piercing marine drive assembly of claim 14, further comprising:

a trim ring;

said trim ring providing an interface that facilitates attachment between said first and second rubber boots and said transom;

said trim ring adapted to limit movement of said outdrive so that said outdrive does not tear into said transom;

said trim ring further adapted to limit movement of said outdrive so that said outdrive cannot damage said universal joints or exceed trimming or steering capacities.

18. The surface piercing marine drive assembly of claim 17, further comprising:

a forward thrust bearing positioned inside of the drive housing;

a rearward thrust bearing positioned inside of the drive housing;

a thrust collar for each thrust bearing;

a plurality of thrust bolts for each thrust bearing;

whereby thrust generated by rotation of said propeller is transmitted sequentially to said propeller shaft, said thrust bearing, said thrust collar, said thrust bolts, said drive housing, said vertical steering plate, said vertical pivot pins, said trim frame, said horizontal pivot pins, said stringer caps, and to said stringers.

19. The surface piercing marine drive assembly of claim 18, further comprising:

a first seal block positioned on a first end of said thrust bearings and said thrust collars;

a second seal block positioned on a second end of said thrust bearings and said thrust collars;

said seal blocks having inner O-rings and outer O-rings that seal opposite ends of said drive housing, keeping water out of said thrust bearings in the interior of the drive housing and keeping oil inside the drive housing to lubricate the thrust bearings.

20. The surface piercing marine drive assembly of claim 7, further comprising:

said jackshaft being a slider jackshaft having a telescopic movement;

said telescopic movement enabling fore and aft displacement to accommodate small changes in length that occur on the jackshaft as said outdrive is trimmed up or down or steered left or right.

21. The surface piercing marine drive assembly of claim 1, further comprising:

said propeller including a propeller hub;

a drive housing for housing said propeller shaft;

said drive housing including an inner drive housing and an outer drive housing, said outer drive housing disposed in ensleeving relation to said inner drive housing;

said transom having an opening to accommodate said inner drive housing so that the diameter of the opening in the transom is minimized; and said outer drive housing adapted to match said propeller hub.

22. The surface piercing marine drive assembly of claim 21, further comprising:

a removable foot secured to said drive housing;

a plurality of foot bolts adapted to secure said removable foot to said drive housing;

whereby removal of said removable foot from said drive housing enables changing and replacing of said plurality of leading rubber boots and said plurality of trailing rubber boots; and whereby removal of said removable foot further enables assembly of said drive housing through said trim ring into said watercraft.

23. A surface piercing marine drive assembly for a watercraft, comprising:

said watercraft having a transom and a propeller disposed aft of said transom;

an articulating frame assembly disposed fore of said transom;

said articulating frame assembly adapted to turn said water craft in a substantially horizontal plane and to raise and lower said propeller in a substantially vertical plane;

said watercraft having a port stringer and a starboard stringer, said stringers being substantially perpendicular to said transom;

a stringer cap secured to each stringer in overlying relation thereto;

a vertically disposed brace secured to each stringer cap;

a first "T"-brace having a base secured to said transom at a first end thereof, and a wall secured to said vertically disposed brace;

a second "T"-brace having a base secured to said transom at a second end thereof, laterally spaced from said first end, and a wall secured to said vertically disposed brace;

whereby forces applied to said transom are distributed across said transom and delivered to said respective walls of said first and second "T"-braces and to said vertically disposed braces and hence to said stringer caps and stringers.

24. The surface piercing marine drive assembly of claim 3, further comprising:

a sliding shaft for telescopically receiving a leading end of said propeller shaft.

25. The surface piercing marine drive assembly of claim 24, further comprising:

said sliding shaft being disposed within said inner drive housing.

26. The surface piercing marine drive assembly of claim 24, further comprising:

said sliding shaft having an internal diameter slightly greater than an external diameter of said propeller shaft;

a plurality of longitudinally extending, circumferentially spaced male splines formed in said leading end of said propeller shaft, said male splines extending radially outwardly;

a plurality of longitudinally extending, circumferentially, matching receiver female splines cooperatively formed in a lumen of said sliding shaft and adapted to slideably receive said male splines;

whereby said propeller shaft is slideably movable within said lumen of said sliding shaft.

* * * * *